United States Patent [19]

Hirota et al.

[11] 4,358,919

[45] Nov. 16, 1982

[54] METHOD AND APPARATUS OF MAKING A HERMETICALLY SEALED CONTAINER

[75] Inventors: Kazumi Hirota, Tokyo; Kikuo Matsuoka; Ichiro Hori, both of Yokohama, all of Japan

[73] Assignee: Toyo Seikan Kaisha, Limited, Tokyo, Japan

[21] Appl. No.: 161,089

[22] Filed: Jun. 19, 1980

[30] Foreign Application Priority Data

Jun. 29, 1979 [JP] Japan ..... 54-81294

[51] Int. Cl.[3] ..... B65B 47/02; B65B 47/04

[52] U.S. Cl. ..... 53/453; 53/471; 53/559; 53/561; 53/579

[58] Field of Search ..... 53/453, 456, 471, 478, 53/559, 561, 579, 574; 493/338, 339, 74

[56] References Cited

U.S. PATENT DOCUMENTS

| | | | |
|---|---|---|---|
| 2,378,324 | 6/1945 | Ray et al. | 53/579 X |
| 2,790,287 | 4/1957 | Kraft et al. | 53/579 X |
| 2,972,215 | 2/1961 | Danielzig et al. | 53/579 |
| 3,092,940 | 6/1963 | David | 53/453 |
| 3,195,284 | 7/1965 | Crane, Jr. | 53/453 |
| 3,509,682 | 5/1970 | Logemann | 53/298 X |
| 3,526,186 | 9/1970 | Cornelius | 53/453 |
| 4,048,781 | 9/1977 | Johansen | 53/453 |

*Primary Examiner*—Horace M. Culver
*Attorney, Agent, or Firm*—Martin A. Farber

[57] ABSTRACT

There are disclosed a process and apparatus for producing sequentially a hermetically sealed container which comprise cutting a blank, forming a container body from the blank by a drawing method, filling a content in the container body and hermetically sealing the container body with a lid member, and devices for realizing these operations. The blank which is cut at a blanking station is placed on a movable die, and drawn to a container body at a drawing station. The container body engaged with the movable die is filled with a content at a filling station, and then hermetically sealed with a lid member at a sealing station. This process and apparatus are especially suitable for a blank made of a flexible material.

10 Claims, 6 Drawing Figures

METHOD AND APPARATUS OF MAKING A HERMETICALLY SEALED CONTAINER

The present invention relates to a method and apparatus for making a hermetically sealed container. More particularly, the invention relates to a process and apparatus for making a hermetically sealed container which comprises filling a content in a drawn container body in an engaged state with a movable die used for drawing the container body and hermetically sealing the filled container body in the same engaged state with a lid member.

Heretofore, a container body formed by a drawing method had been taken out from a die, thereafter transported to apparatus located at a distant place, filled with a content and hermetically sealed. However, such a process has had economic problems such as complicating the steps and inviting a high cost by transfer. Further, in case the container body was made of, for example, a flexible laminated plastic film having a thickness of less than about 100 μm and, of poor self-shape retentivity, there have been problems that the shape of the container body, especially the side-wall portion thereof after being taken out from the die has collapsed, making it difficult or impossible to fill the content in the container body, or even though the filling of the content is possible, the flange portion of the container body has been deformed, so that it became difficult or impossible to completely hermetically seal the flange portion with the lid member by adhesion or heat seal.

In case the container body is made of a material having a spring-back property, after it was taken out from the die, the outer diameter of the side-wall portion and the flange portion expand, and the extent of such expansion is not uniform in respect of the respective container bodies, which leads to a problem that variation of the outer diameters of sealed containers is brought about.

In order to solve the foregoing problems, we propose herein a process of transferring of a drawn container body, filling the container with a content and sealing it with a lid portion while it is engaged with a die without taking it out of the die, namely, the use of a movable die.

However, in this case also, as has been customarily used in the conventional drawing method, in case the upper end portion on the outer periphery of the die is used as a lower blade for cutting a blank, it is difficult to precisely position within a short period of time the movable die with respect to a drawing machine. Therefore, it has been impossible to secure a clearance of about 1/100 mm ordinarily required between an upper blade and the lower blade, and there has been a possibility of often inviting poor cutting or impossibility of cutting the blank. Further, even if it is possible to cut the blank, in case the blank is made of a flexible material, there has been a problem that curling or folding has been brought about in the blank during cutting, which tends to result in a poor drawn container body.

The present invention attempts to solve the foregoing problems of the prior art.

A general object of the present invention is to provide an economical continuous process and apparatus for making a hermetically sealed drawn container.

Another object of the present invention is to provide apparatus for making a hermetically sealed container equipped with a device capable of cutting a blank made of a flexible material without bringing about curling or folding.

Still another object of the present invention is to provide apparatus for making a hermetically sealed container equipped with a drawing machine which does not cause trouble such as impossibility of cutting a blank even though a movable die is not particularly positioned precisely.

A further object of the present invention is to provide a process and apparatus for making a hermetically sealed container suitable for filling and sealing a container body made of a flexible material shaped by a drawing method and of poor self-shape retentivity.

A still further object of the present invention is to provide a process and apparatus for making a hermetically sealed container wherein a constant outer diameter thereof is ensured even though a blank of a material of a spring-back property is used.

The inventors have found that the aforementioned objects may be achieved by separating a blank cutter from a drawing machine, transferring a movable die sequentially from a blanking station through a drawing station and a filing station to a sealing station, placing a cut blank on the movable die at the blanking station, drawing a container body from the blank at the drawing station, filling a content in the container body engaged with the movable die at the filling station and with a lid member sealing the container body which is engaged with the movable die and filled with the content at the sealing station.

The present invention will now be described in detail in connection with the embodiments thereof with reference to the accompanying drawings.

Figure 1:
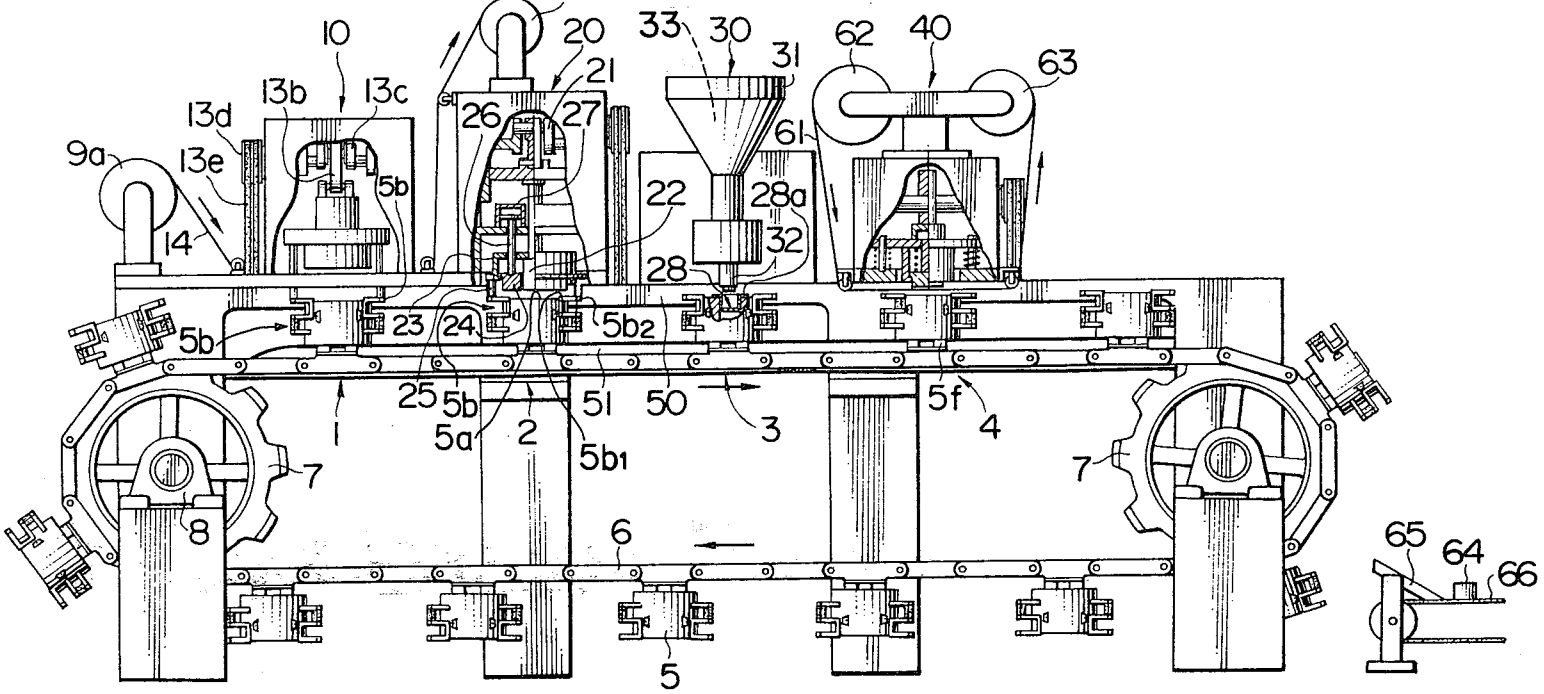
FIG. 1 is a fragmentary front elevation view of apparatus showing one embodiment of the present invention with portions cut away and in section.

An apparatus for making a continuously drawn, filled and sealed container shown in FIG. 1 comprises a blanking station 1, a drawing station 2, a filling station 3 and a sealing station 4, wherein a plurality of movable dies 5 mounted at regular intervals on an endless transfer chain 6 are transferred in the arrow direction, stop at each of the stations, and when they stop, blanking, drawing, filling of a content and hermetical sealing of a lid member are carried out sequentially.

A bearing pedestal 8 supporting the center axis of a sprocket 7 for moving the transfer chain 6, a pay-off reel 9*a* for unwinding a shaping material, a blanking device 10, a drawing machine 20, a filling device 30 and a sealing device 40 are fixedly secured to a common frame 50.

Figure 2:
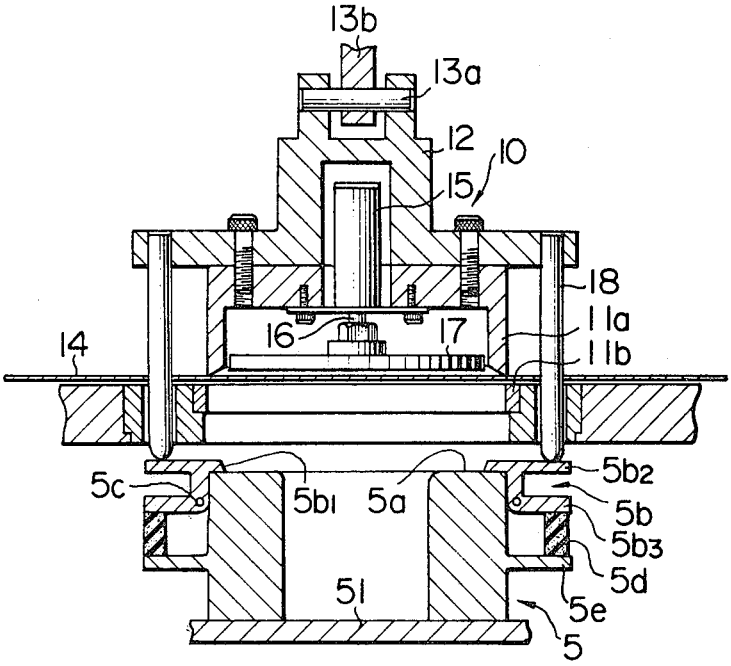
FIG. 2 is a vertical section view showing one example of a blanking device used in the present invention.

As is shown in FIG. 2, the blanking device 10 is equipped with a movable cutter (upper blade) 11*a* and a stationary cutter (lower blade) 11*b*, and the movable cutter 11*a* is fixedly secured to a cutter holder 12. The cutter holder 12 is moved up and down by a driving device (such as a motor) not shown via a pin 13*a*, a connecting rod 13*b*, a crank 13*c*, a pulley 13*d* and a belt 13*e*, and a sheet- or film-shaped shaping material 14 supplied intermittently from the pay-off reel 9*a* is cut into blanks 19 of a predetermined dimension.

A strip-like scrap after the blanks are cut is wound up by a scrap windup-reel 9*b*. Because in the present invention, as mentioned above, the stationary cutter 11*b* is provided independently of the movable die 5, especially precise positioning of the movable die is not required for blank cutting. In the central concave portion of the cutter holder 12, an air cylinder 15 is fixedly received, and to the lower end portion of a piston rod 16, there is fixedly secured a blank pusher 17 which descends with the motion of the air cylinder 15, and by pushing forces down the cut blank 19 until it reaches the upper surface 5*a* of the movable die 5.

Further, a plurality of guide rods 18 are fixedly secured to the vicinity of the outer end of the cutter holder 12. The bottom end surface of the guide rod 18 is in contact with the upper surface of the outside portion $5b_2$ of the upper flange of a clamp 5*b* provided swingably with respect to the movable die 5.

Figure 3:
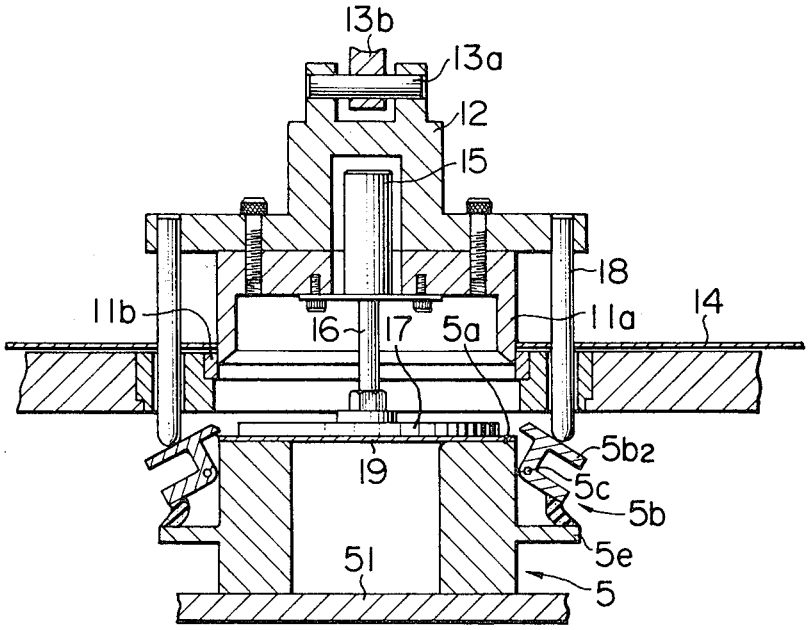
FIG. 3 is a vertical section view showing the state when a movable cutter reaches a bottom dead point in the device shown in FIG. 2.

At a timing before the movable cutter 11*a* descends and cuts the shaping material 14 (FIG. 2), the inside portion $5b_1$ of the upper flange of the clamp 5*b* is in contact with the outside portion of the upper surface 5*a* of the movable die 5. With commencement of cutting of the blank, the outside portion $5b_2$ of the upper flange of the clamp 5*b* is pushed down by the guide rod 18 with a pin 5*c* acting as a rotary shaft, and as shown in FIG. 3, the inside portion $5b_1$ of the upper flange is spaced away from the upper surface 5*a* of the movable die 5, so that the punched blank 19 is not prevented from coming into close contact with the upper surface 5*a* of the movable die 5 by the clamp 5*b*.

Between the lower flange $5b_3$ of the clamp 5*b* and the protrusion 5*e* of the movable die 5 is provided a cushion 5*d* made of such material as elastic rubber, and with elevation of the cutter holder 12 and the guide rod 18, as shown in FIG. 2, the inside portion $5b_1$ of the upper flange of the clamp 5*b* returns to the original position by the action of the cushion 5*d*, thereby to tightly clamp the blank 19 on the upper surface 5*a* of the movable die 5. By the foregoing operation of the blank pusher 17 and the clamp 5*b*, the blank 19 is prevented from curling or folding.

Figure 4:
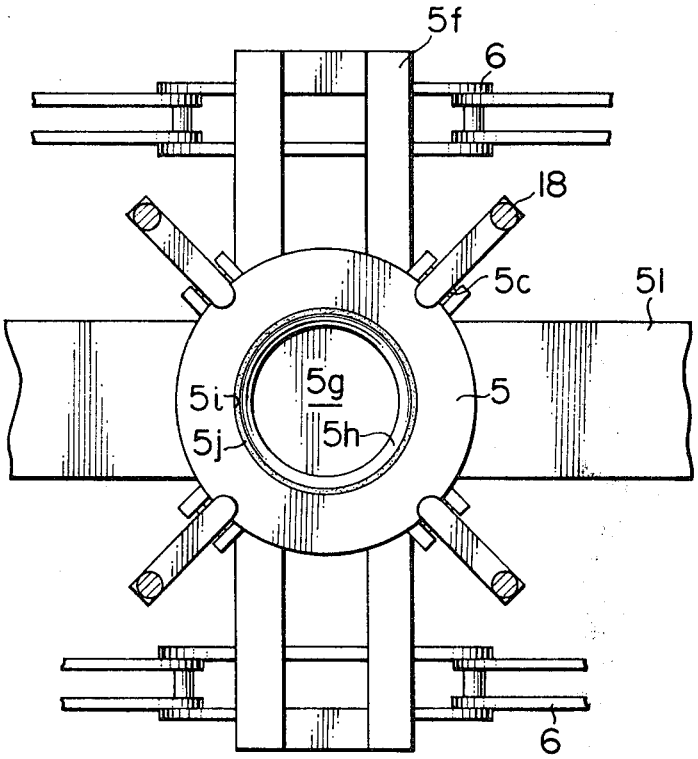
FIG. 4 is a plan view of one example of a movable die used in the present invention.

As shown in FIG. 4, the movable die 5 is fixedly secured to a die mounting plate 5*f* bestriding between a pair of transfer chains 6 juxtaposed to each other, and is adapted to slide on the upper surface of a guide plate 51 fixedly secured to the frame 50 in accordance with the movement of the transfer chain 6. Accordingly, even though a downward pushing force is applied to the movable die 5 with descending of the blank holder 17, the movable die 5 cn maintain its constant position. The same can be said of the movable die 5 at the drawing station 2, the filling station 3 and the sealing station 4. Namely, even though a downward force is applied to the movable die 5 staying at these stations, the movable die 5 supported by the guide plate 51 does not descend.

On the upper surface 5*a* of the movable die 5 is provided a narrow groove 5*i* in parallel to and outside a die curvature 5*h* constituting the upper end portion of a die cavity 5*g*, and inside of the groove 5*i* is buried an elastomer 5*j* such as heat-resistant silicone rubber. The elastomer 5*j* functions as a cushion for protecting the edge of a blade when the lid material heat sealed or adhered to the flange portion of the container body is melt cut along the peripheral line of the flange portion in the sealing station.

As a drawing machine 20, for example, such a single action press as was previously proposed by us (Laid-open Japanese Patent Publication No. 5136/1980, but not prior art) is used. In FIG. 1 a drawing machine of this type is exhibited. In FIG. 1, to the attaching position of a punch 22 which is subjected to an up-and down-motion by rotation of a crank 21, a retainer 23 is fixedly secured. When the punch 22 is positioned at the vicinity of a top dead point, the retainer 23 engages a blank holder 24 at a convex portion of the inside lower end of the former, deterring descent of the blank holder 24. A guide rod 25 fixedly secured to the lower surface of the retainer 23 is in contact with the outside portion $5b_2$ of the upper flange of the clamp 5*b* of the movable die 5. The blank holder 24 is always applied with a substantially constant downward force by an air cylinder 27 via a piston rod 26 fixedly secured to the upper side thereof.

The apparatus of the present invention being so constructed as mentioned above, with descending of the punch 22, the retainer 23 descends also, and by means of the guide rods 25 pivoting and pushing down the outside portion $5b_2$ of the upper flange of the clamp 5*b*, spaces away outwardly the inside portion $5b_1$ of the upper flange of the clamp from the upper surface 5*a* of the movable die 5, and at the same time, the blank holder 24 descends being disengaged from the retainer 23. Thereafter, the blank 19 closely contacting the upper surface 5*a* of the movable die 5 is applied with a predetermined pressure by the pressure of the cylinder 27. Subsequently, the punch 22 continues to descend inside of the die cavity 5*g* to draw the blank 19.

In the present invention, so as to enable sealing of the container body by adhering or heat sealing the lid member, drawing is terminated in such a state that a flange portion 28*a* remains. After completion of the shaping, the retainer 23 ascends together with the punch 22 and the clamp 5*b* returns to the original position. Since at this time the outer diameter of the flange portion 28*a* is considerably smaller than that of the blank 19, the clamp 5*b* does not clamp the flange portion 28*a* of the drawn container body 28. When the punch 22 further ascends, the retainer 23 engages the blank holder 24 and the blank holder 24 ascends also.

In case the shaping material 14 is relatively thin and flexible, during the drawing operation wrinkles tend to be generated on the upper curvature portion 5*h* (see FIG. 4) of the cavity of the die 5, and remain in the side-wall and flange portions of the drawn container body, with a result of impairing the appearance, further ruining the sealability of the lid member. Accordingly, in such a case, it is desirable to use such a punch as having an outer layer portion made of an elastomer surrounding a rigid core thereof and having an outer diameter larger than the minimum diameter of an upper curvature portion 5*h* of the cavity of the die 5 as was previously proposed by us in Laid-open English Patent Publication No. 2001893. However, in case the shaping material 14 is relatively thick and rigid, the punch 22 may consist of a conventional rigid body (such as steel).

The filling device 30 (FIG. 1) is a device for filling a content in the so shaped container body 28 while it is located in the movable die 5 with which it is engaged at the flange portion, and has a hopper 31 for storing the content 33 and a nozzle 32 discharging a predetermined amount of the content 33.

The nozzle 32 is controlled by, for example, an electromagnetic value and opened for the time of period necessary for filling a predetermined amount of the content 33 in the drawn container body 28.

The sealing device 40 is adapted to seal the flange portion 28*a* of the container body 28 which is filled with the content 33 with a lid material 61 by adhesion or heat sealing, and at the same time, to cut the lid material 61 along the outer periphery of the flange portion 28*a*. The lid material 61 is supplied from a pay-off reel 62, runs intermittently adjacent to the upper surface 5*a* of the movable die 5, and the scrap formed by cutting the lid member from the lid material 61 after the sealing operation is wound up by a scrap windup reel 63.

Figure 5:
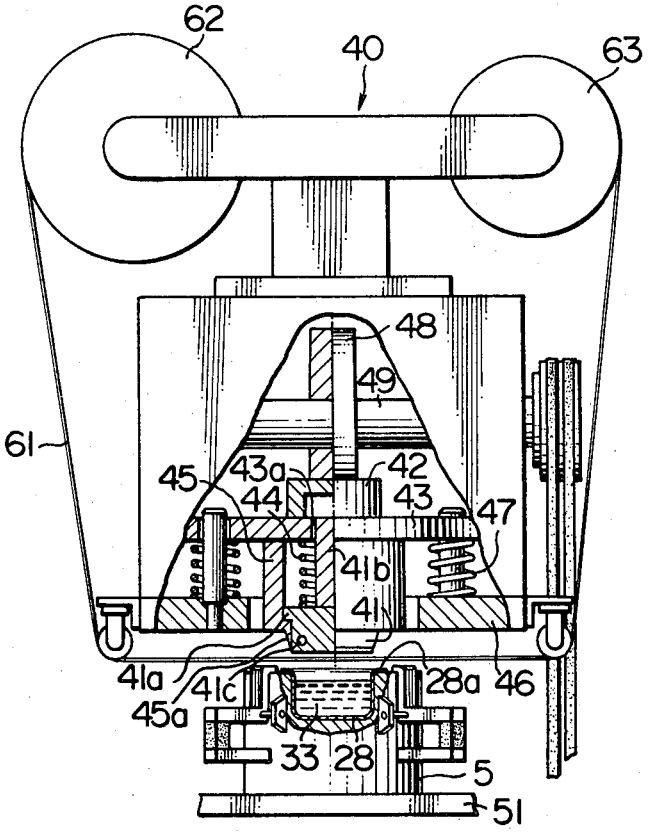
FIG. 5 is an enlarged fragmentary front elevation view of a sealing device of FIG. 1.

In FIG. 5, a spring 44 is provided between the upper surface of a sealer 41 for pushing the lid member onto the flange portion 28*a* for joining the two and the lower surface of a movable plate 43 fixedly secured to a cam follower 42, and the sealer 41 is engaged with a cutter 45 fixedly secured to the movable plate 43 at an upper protrusion 41*a*. It is desirable that the outer diameter of the lower surface of the sealer 41 is about same as that of the flange portion 28*a*. A shaft 41*b* fixedly secured to the sealer 41 is adapted to slide up and down along a bush 43*a* inside the center hole of the movable plate 43. Between the lower surface of the movable plate 43 and the upper surface of a stationary plate 46, a return spring 47 is provided. A cam 48 is rotated by a cam shaft 49 driven by a driving device which is not shown. The inner peripheral surface of the edge of the blade 45*a* of the cutter 45 is in contact with the outer peripheral surface of the lower portion of the sealer 41, so that the edge of the blade 45*a* may be heated to a predetermined temperature by a heater 41*c* provided inside the sealer 41. In case the edge of the blade 45*a* is not heated sufficiently by the heater 41*c*, a heater may be provided inside the cutter 45 or the edge of the blade 45*a* may be heated from the outside.

The sealing device 40 operates in the following manner. In accordance with the rotation of the cam 48, the sealer 41 descends together with the cam follower 42, the movable plate 43 and the spring 44, and pushes the lid material 61 onto the flange portion 28*a* on the upper surface 5*a* of the movable die 5 by the pressure of the spring 44 for a certain time of period determined by the profile of the cam 48. At that time, in case the lower surface of the lid material 61 and the upper surface of the flange portion consist of a heat sealable material such as polyethylene, the two are sealed by heat fusion, while in case either one of the aforesaid two surfaces is applied with a pressure-sensitive adhesive or a heat-sensitive adhesive, sealing is effected by adhesion.

While the sealer 41 pushes as aforementioned, the cutter 45 further descends, and in case the lid material 61 consists mainly of a thermoplastic resin sheet or film (including a laminate with an extremely thin aluminium foil), the lid material 61 is melt cut along the outer periphery of the flange portion 28*a* by the edge of the blade 45*a*. In this case the heat resistant elastomer 5*j* provided on the upper surface 5*a* of the movable die 5 serves to protect the edge of the blade 45*a*. After completion of the aforementioned motions, in accordance with the rotation of the cam 48, the cutter 45 and the sealer 41 ascend by the action of the return spring 47.

At the rear lower side of the sprocket 7 provided on the outlet, a chute 65 for receiving the hermetically sealed container 64 falling by gravity from the movable die 5 and a conveyor 66 for transporting the container 64 are provided.

Next, an explanation will be made with reference to a process for producing a hermetically sealed container by the aforementioned apparatus. The respective movable dies 5 are transferred by the transfer chain 6 and stand still at predetermined positions below the cutter 11 of the blanking device 10, the punch 22 of the drawing machine 20, the nozzle 32 of the filling device 30 and the sealer 41 of the sealing device 40, namely the positions where the center axes of the respective movable dies coincide with those of the aforesaid respective devices. A timing is taken utilizing the cam structure and a limit switch so that during this transfer period, the shaping material 14 and the lid material 61 may be moved for distances somewhat longer than the diameter of the blank and the diameter of the flange portion, respectively, and the movable cutter 11*a*, the punch 22 and the sealer 41 may be positioned near their top dead points.

The present invention is especially suitable for the relatively flexible shaping material 14 consisting of a metal foil thinner than about 100 μm or a plastic sheet or film thinner than about 200 μm or a laminated material having a metal foil thinner than about 100 μm and a plastic sheet or film thinner than about 200 μm. However, the present invention is applicable to a relatively rigid material such as, for example, black plate, tin plate, a zinc-plated steel sheet, tin-free steel, an aluminum (alloy) sheet and a lacquered sheet thereof, a plastic sheet and a laminate of plastics and a metal foil in accordance with the aimed use.

While the movable dies 5 stand still, the punching of the blank, the placing of the blank on the upper surface 5*a* of the die 5, the drawing, the filling of the content 33, the joining of the lid material with the flange portion, and the melt cutting of the lid member proceed simultaneously. In the case of a container formed from a flexible material, a product which is in a liquid state when heated (in this case, the product is heated to a proper temperature inside the filling device) and in a solid state when cooled to the room temperature after filled, for example, jelly, pudding and cheese and so forth, is especially suitable as a content of the sealed container. However, the content to be filled is not limited thereto, but may be a product which is originally solid such as, for example, hamburger, although in this case the filling device for filling a fluid illustrated in FIG. 1 has to be replaced by a filling device for filling a solid.

In case the content is food and requires high-temperature retort sterilization, the flange portion and the lid member have to be sealed by heat fusion, namely, heat sealed to each other, and the shaping material 14 and the lid material 61 suitable therefor have to be selected. Heat seal referred to herein includes a hot plate heating method, an impulse heating method, an ultrasonic heating method and a high frequency heating method and so forth.

In FIG. 1 and FIG. 5, the hot plate heating method are illustrated. In case the other method is adopted, the device of FIG. 5 may be replaced by a device suitable therefor. In case a low temperature pasteurization treatment is carried out or the content is not food and does not require sterilization, the container body and the lid member are adhered to each other by an adhesive such as heat-sensitive, a pressure-sensitive or a solvent type adhesive. When the foregoing respective operations are completed and the blank pusher 17, the punch 22 and the sealer 41 ascend, the movable die 5 is transferred with the transfer chain 6 by a distance between the adjacent stations again and the aforesaid operations are repeated. The thus produced hermetically sealed container 64 is forwarded to the next step by a conveyor 66.

As mentioned above, according to the process of the present invention, the filling of the content and the sealing of the lid member are carried out without taking out the drawn container body 28 from the die 5. Therefore, even in case the container body is formed from a flexible material and poor in self-shape retentivity, the shape of the container does not collapse and it is possible to fill a content and seal securely. Also even in case the container body is formed from a material having a spring-back property, it is possible to ensure the dimension of the hermetically sealed container at a predetermined constant value.

Figure 6:
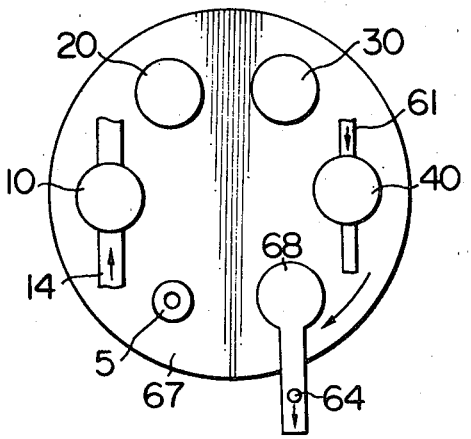
FIG. 6 is a schematic plan view of apparatus showing another embodiment of the present invention.

Though the foregoing embodiment carries out the transfer of the movable die by a conveyor system, as shown in FIG. 6, a turn-table system may be adopted as well. This system comprises a plurality of movable dies 5 provided at regular intervals on a turn table 67 which is adapted to rotate in the arrow direction, a blanking device 10, a drawing machine 20, a filling device 30 and a sealing device 40 such as are illustrated in FIG. 1 which are provided at regular intervals above the turn table 67. The structures and functions of these devices are the same as aforementioned. Reference numeral 68 shows a discharging device for pushing up the produced sealed container 64 out of the movable die 5 and carrying away the container 64 to the outside of the turn table 67.

The present invention is not limited to the aforesaid embodiments. For example, in the case of using a relatively thick shaping material, the blank closely contacts the upper surface of the die by its own weight and there is no possibility for it to slip out of place while the die transfers to the next station, so that the clamp **5*b*** does not necessarily have to be provided.

It goes without saying that a single action or double action drawing machine other than one illustrated in FIG. 1 is usable insofar as the transfer of the die in the horizontal direction is possible. Further, in case the lid member is made of a material difficult to be melt cut such as, for example, a relatively thick metal material, it is possible to produce a lid blank by a separate device in advance and place the same on the flange portion to join the two. In case the lid member is made of a material relatively easy to be cut, it is possible not to provide the elastomer **5*j* inside the narrow groove 5*a* on the upper surface 5*a* of the movable die 5 and to effect cutting using a non-heated rotary blade or a sawtooth blade as the cutter 45**.

It is further possible to additionally provide a vacuum absorption device to the sealing device to carry out a vacuum sealing operation, if necessary. It is a matter of course that the shape of the container body may take any shape such as oval or round-corner square or cylindrical.

Hereinbelow, the present invention will be explained by way of a practical example.

Practical Example

A flexible laminate strip obtained by adhering a 40 μm thick undrawn nylon 6 film, a 15 μm thick soft aluminum foil and a high density (density 0.96) polyethylene film adhered to each other in this order with an isocyanate adhesive was used as a shaping material, which was punched into blanks having a diameter of 115 mm with the polyethylene film as an upper surface using the apparatus of the type shown in FIG. 1.

The blanks were thereafter drawn into container bodies having a diameter of the side-wall portion of 65 mm, a depth of 15 mm and a width of the flange portion of 10 mm. Container bodies which are beautiful in appearance and free from wrinkles could be obtained by the use of a punch whose outer layer portion was made of polyurethane rubber having Shore hardness of A 80. Subsequently at the filling station, the container bodies were filled with liquid jelly heated to about 60° C., and then a lid material made of the same laminate as the shaping material and with the polyethylene film downside was heat fused with the flange portion of the container body, and the lid material was melt cut along the edge of the outer periphery of the flange portion.

The so obtained hermetically sealed container kept round in the side-wall portion and the flange portion, without creating collapse of the shape. Hermetically sealing was completely achieved, and the hermetically sealed container was subjected to a 127° C.×15 min. retort sterilization treatment, without inducing any defects such as peeling. After being stored at 37° C. for 6 months, no abnormality such as putrefaction of the content occurred at all.

On the other hand, after the aforesaid drawn container body was taken out of the die, the outer diameter of the upper part of the side-wall portion was measured. It was found that the outer diameter was larger than the inner diameter of the die cavity insignificantly only by about 0.5–1.0 mm., namely, the side-wall portion expanded to some extent by springing-back action. Accordingly, the diameter of the flange portion expanded also with expanded amounts varying among the respective container bodies within the aforesaid range, namely, about 0.5–1.0 mm.

Therefore, it was found that the conventional system of filling a content in a container body after taking the container body out of the die results in some variety of the dimensions, especially the diameter of the hermetically sealed container.

To the contrary, according to the present invention, wherein the container body is filled with a content and sealed within the lid member while it is engaged with the die, the flange portion of the sealed container after taken out of the die is bound by the lid member and cannot expand. Namely, according to the process and apparatus of the present invention, there is an advantage that hermetically sealed containers of constant dimension can be obtained.

What is claimed is:

1. In a process for making a hermetically sealed container which comprises placing a blank on a movable retainer which is at a standstill at a blank placing station; moving said retainer together with said blank in a horizontal direction to a forming station and forming a cup-shaped container body having a flange portion from said blank by using said retainer and a cooperating punch; moving said retainer together with said container body which is engaged with said retainer at said flange portion, in a horizontal direction to a filling station, and filling a product in said container body; and moving said retainer together with said container body filled with said product, in a horizontal direction to a sealing station, and heat sealing said flange portion with a lid member, the improvement which comprises using as said retainer a die which is movable in a horizontal direction and is provided with a cavity having a sidewall of a configuration corresponding to a sidewall portion of said container body; punching said blank from a web of a relatively thin and flexible material at said blank placing station, pushing down and placing said blank on said die, and clamping the peripheral portion of said blank on said die; moving said die on which said blank is clamped to said forming station and then releasing the clamping; and drawing said blank at said forming station using said die and said punch, so as to form said container body the sidewall portion of which is in closely contacting relationship with the sidewall of said cavity.

2. A process claimed in claim 1 wherein said web is formed of a thermoplastic resin and thinner than about 200 μm.

3. A process claimed in claim 1 wherein said web is formed of a laminate consisting essentially of a metal foil having a thickness less than about 100 μm and a thermoplastic resin film having a thickness less than about 200 μm.

4. A process claimed in claim 1 wherein said hermetically sealed container can withstand a retort sterilization treatment.

5. In an apparatus for making a hermetically sealed container which comprises a retainer, a blank placing station provided with means for placing the blank on said retainer, a forming station provided with a punch for forming a cup-shaped container body having a flange portion from said blank in cooperation with said retainer, a filling station provided with means for filling a product in said container body which is engaged with said retainer at said flange portion, a sealing station provided with means for heat sealing said flange portion with a lid member, and means for moving said retainer in the horizontal direction and stopping said retainer at said respective stations, the improvement in which a movable die comprises said retainer, said movable die being formed with a cavity having a sidewall of a configuration corresponding to a sidewall portion of said container body, said moving means adapted for stopping said die under said blank placing station, a cutter means provided at said blank placing station and having means comprising a movable cutter blade and an operative cooperating stationary cutter blade for punching said blank from a web formed of a relatively thin flexible material, said placing means is for placing said blank on said die while at a standstill below said cutter means and for pushing down said blank onto said die, means for clamping a peripheral portion of said blank on said die, said die, while said peripheral portion is clamped by said clamping means, being movable in a horizontal direction to said forming station by said moving means, said die cooperating with said forming station for being capable in said forming station for forming said container body by drawing said blank in cooperation with said punch such that said sidewall portion of said container body closely contacts, said sidewall of said cavity of said die, said moving means moving said die with said container body in said cavity closely contacting said sidewall thereof to said filling station for the filling and then to said sealing station for sealing the lid member to the flange portion, respectively, with said container body continuously in said cavity closely contacting the die.

6. An apparatus claimed in claim 5, wherein said means for clamping comprises an inside flange portion adapted to clamp the peripheral portion of the blank, and an outside flange portion connected fixedly to said inside flange portion and extending radially and outwardly, said outside flange portion being supported swingably and biased elastically respectively with respect to said die, push-down means for pushing down said outside flange portion such that said inside flange portion detaches apart from the upper surface of said die, said outside flange portion being supported swingably and biased elastically respectively such that said inside portion returns elastically and clamps said blank upon release of the push-down means.

7. An apparatus claimed in claim 5, wherein said means for placing said blank and pushing down said blank comprises a blank pusher having a flat bottom surface which is slightly smaller in diameter than said blank.

8. An apparatus claimed in claim 5, wherein said stationary cutter blade is provided independently of said movable die whereby precise positioning of the latter is not required for the blank cutting.

9. An apparatus claimed in claim 5, wherein said punch has an outer layer portion made of an elastomer surrounding a rigid core thereof and having an outer diameter larger than the minimum diameter of an upper curvature portion of the cavity of the die.

10. An apparatus claimed in claim 1, wherein said web is resilient and is maintained by its resiliency in said cavity in said closely contacting relationship continuously during movement of the die to the filling and sealing station and during the filling and sealing steps respectively.

* * * * *

UNITED STATES PATENT AND TRADEMARK OFFICE

CERTIFICATE OF CORRECTION

PATENT NO. : 4,358,919

DATED : November 16, 1982

INVENTOR(S) : Kazumi Hirota, et al

It is certified that error appears in the above–identified patent and that said Letters Patent are hereby corrected as shown below:

Column 10, Line 4, (claim 5) "for" should read --of--

Signed and Sealed this

*Eighth* Day of *February 1983*

[SEAL]

*Attest:*

GERALD J. MOSSINGHOFF

*Attesting Officer*

*Commissioner of Patents and Trademarks*